US011549673B2

(12) United States Patent
Franzosi et al.

(10) Patent No.: US 11,549,673 B2
(45) Date of Patent: Jan. 10, 2023

(54) LIGHTING APPARATUS

(71) Applicant: ARTEMIDE S.P.A., Milan (IT)

(72) Inventors: Roberto Efrem Franzosi, Milan (IT); Andrea Gallucci, Guanzate (IT)

(73) Assignee: ARTEMIDE S.P.A.

( * ) Notice: Subject to any disclaimer, the term of this patent is extended or adjusted under 35 U.S.C. 154(b) by 0 days.

(21) Appl. No.: 16/363,017

(22) Filed: Mar. 25, 2019

(65) Prior Publication Data

US 2019/0293274 A1 Sep. 26, 2019

(30) Foreign Application Priority Data

Mar. 26, 2018 (IT) ..... 102018000003925

(51) Int. Cl.

| | |
|---|---|
| ***F21V 23/04*** | (2006.01) |
| ***F21S 10/00*** | (2006.01) |
| ***F21V 3/02*** | (2006.01) |
| ***F21V 3/06*** | (2018.01) |
| ***F21S 2/00*** | (2016.01) |
| *F21Y 115/10* | (2016.01) |
| *F21Y 107/40* | (2016.01) |

(52) U.S. Cl.

CPC ..... *F21V 23/0485* (2013.01); *F21S 2/005* (2013.01); *F21S 10/00* (2013.01); *F21V 3/02* (2013.01); *F21V 3/06* (2018.02); *F21Y 2107/40* (2016.08); *F21Y 2115/10* (2016.08)

(58) Field of Classification Search

CPC ..... F21V 23/0485; F21V 3/06; F21S 10/00; F21S 2/005; F21S 3/02

See application file for complete search history.

(56) References Cited

U.S. PATENT DOCUMENTS

| | | | | |
|---|---|---|---|---|
| 6,891,200 | B2 * | 5/2005 | Nagai | H01L 25/0753 257/E33.073 |
| 2012/0181951 | A1 * | 7/2012 | Van Der Zande | F21V 23/0442 315/294 |
| 2012/0208378 | A1 | 8/2012 | Rudisill et al. | |
| 2013/0120989 | A1 | 5/2013 | Sun et al. | |
| 2015/0167948 | A1 | 6/2015 | Wasserman et al. | |

(Continued)

OTHER PUBLICATIONS

Extended European Search Report from EP Application No. 19164812.0 dated Jun. 19, 2018, pp. 1-8.

(Continued)

*Primary Examiner* — Rajarshi Chakraborty
*Assistant Examiner* — Nathaniel J Lee
(74) *Attorney, Agent, or Firm* — The Belles Group, P.C.

(57) ABSTRACT

A lighting apparatus comprises a plurality of light modules; each module comprises: a hollow body provided with a light box having a light exit opening and housing a LED light source controlled by a control unit; a diffusing screen positioned on the opening to uniform the light passing through the opening; a closure cover, positioned above the diffusing screen; a transparent capacitive film positioned on a face of the closure cover and connected to the control unit to define a touch control device of the module; the modules are shaped as respective polyhedral sectors arranged around the first axis and each module defines an independent light module controlled by the respective touch control device independently of the other modules.

14 Claims, 3 Drawing Sheets

(56) References Cited

U.S. PATENT DOCUMENTS

| | | | | |
|---|---|---|---|---|
| 2015/0316231 | A1* | 11/2015 | Di Trapani | F21V 5/007 362/147 |
| 2016/0091189 | A1 | 3/2016 | Brown | |
| 2017/0321867 | A1* | 11/2017 | Hagelaar | F21V 14/003 |
| 2018/0320846 | A1* | 11/2018 | Sozzi | F21S 8/061 |
| 2019/0249853 | A1* | 8/2019 | Jensen | F21V 15/01 |

OTHER PUBLICATIONS

Italian Search Report, Ministero dello Sviluppo Economico, Mar. 26, 2018, pp. 1-8.

* cited by examiner

LIGHTING APPARATUS

CROSS-REFERENCE TO RELATED PATENT APPLICATIONS

The present application claims priority to Italian Patent Application No. 102018000003925, filed Mar. 26, 2018. The disclosure of the aforementioned priority, application is incorporated herein by reference in its entirety.

TECHNICAL FIELD

The present invention relates to a lighting apparatus, in particular for ambient lighting (interior and/or exterior).

BACKGROUND ART

In the lighting industry, particularly the interior lighting industry, a large number of different types of lighting apparatuses are known, which can also provide a multiplicity of functions and lighting effects.

A common requirement is to change the luminosity or light intensity.

However, the known apparatuses may not be fully satisfactory, in particular with regard to simplicity and luminosity control efficiency.

On the other hand, in the lighting industry there is a constant search for technical solutions, which also allow them to be integrated into aesthetically original objects and further allow newly-designed lighting effects to be obtained, in which field, in addition to the purely functional aspect, also the aesthetic and emotional component has a key role.

DISCLOSURE OF INVENTION

It is an object of the present invention to provide a lighting apparatus which overcomes the drawbacks of the prior art described herein; in particular, it is an object of the invention to provide a lighting apparatus which is not only fully efficient, simple to manufacture and install, but which also allows the luminosity to be varied in a simple and fully effective manner, also obtaining newly-designed lighting effects.

The present invention therefore relates to a lighting apparatus as defined in appended claim 1.

Further preferred features of the invention are defined in the dependent claims.

The invention provides a lighting apparatus, which is not only simple to manufacture and use, but also fully efficient and highly versatile in controlling luminosity.

Substantially, the apparatus of the invention is formed by a plurality of sectors defining respective light modules, which are independent with regard to switching on and (optionally) luminosity: each sector is equipped with an independent control unit (electronic board) configured to control the operation of the respective sector (switching on/off and luminosity) independently of the operation of the other sectors.

The sectors fully appear in a predetermined colour, in particular black or grey, when they are switched off, and can be switched on or optionally adjusted by manually touching the same surface from which the light emission comes.

The sectors can be combined together into different structures to create lighting apparatuses with different shapes.

BRIEF DESCRIPTION OF THE DRAWINGS

Further features and advantages of the present invention will be apparent from the following description of a non-limiting embodiment thereof, with reference to the figures of the accompanying drawings, wherein.

BEST MODE FOR CARRYING OUT THE INVENTION

Figure 1:
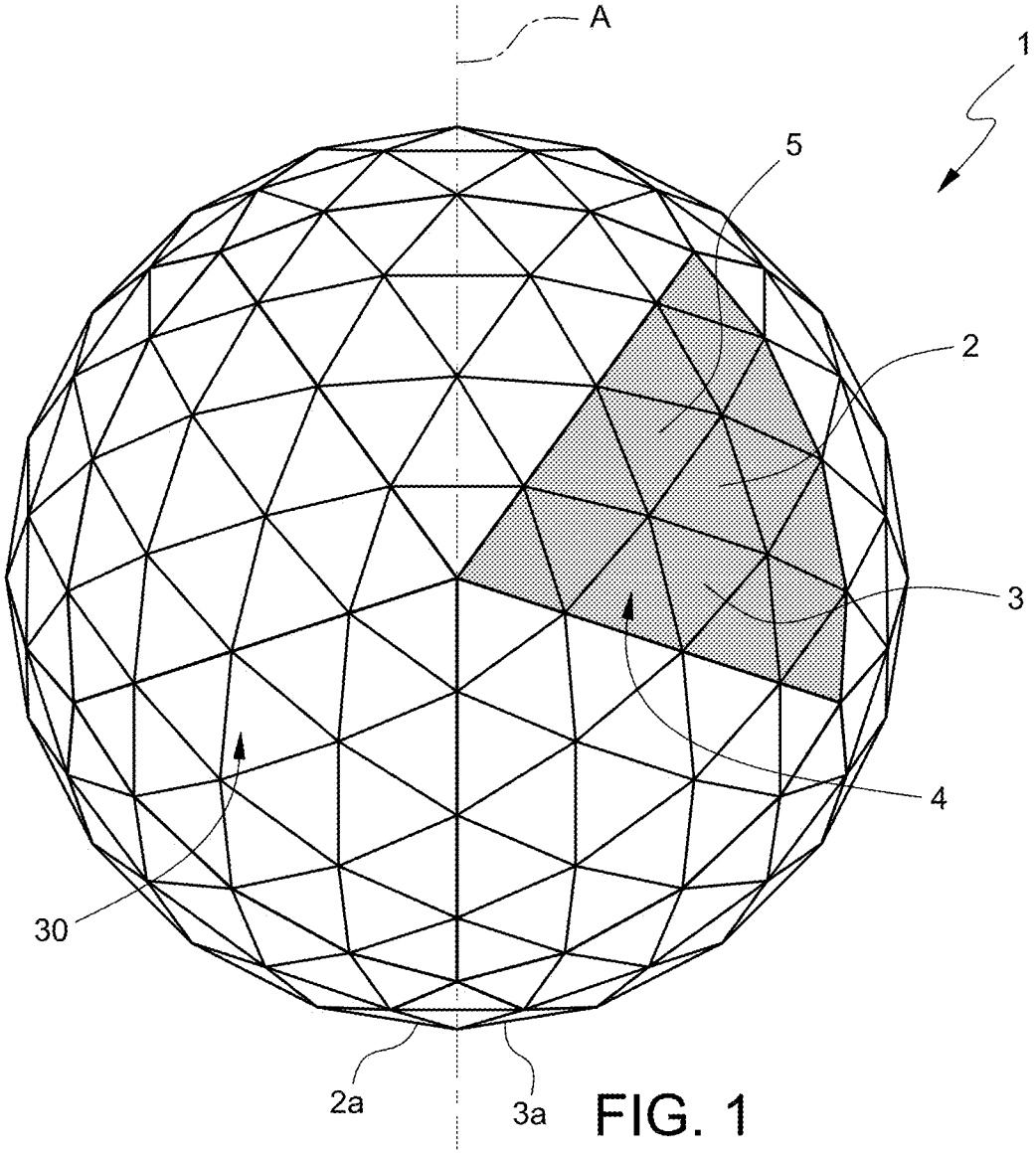
FIG. 1 is a perspective view of a lighting apparatus according to the invention.

In FIG. 1, number 1 indicates, as a whole, a lighting apparatus for lighting indoor and/or outdoor environments.

The apparatus 1 includes a plurality of polyhedral sectors 2 defining respective modules 3 (one of which, for illustrative purposes only, is highlighted in grey, for its identification with respect to the other modules 3).

In particular, the apparatus 1 extends along a central axis A and the sectors 2, therefore the modules 3, are located about axis A, which constitutes a central symmetry axis of the apparatus 1.

Each sector 2, i.e. each module 3, has an outer surface 4, which is a polyhedral surface formed by a plurality of polygonally outlined plane faces 5 and defines the light emitting surface of the module 3.

The shape of the modules 3, i.e. the polyhedral sectors 2, is geometrically defined by the second degree development of a polyhedron on a sphere circumscribing the polyhedron.

Figure 2:
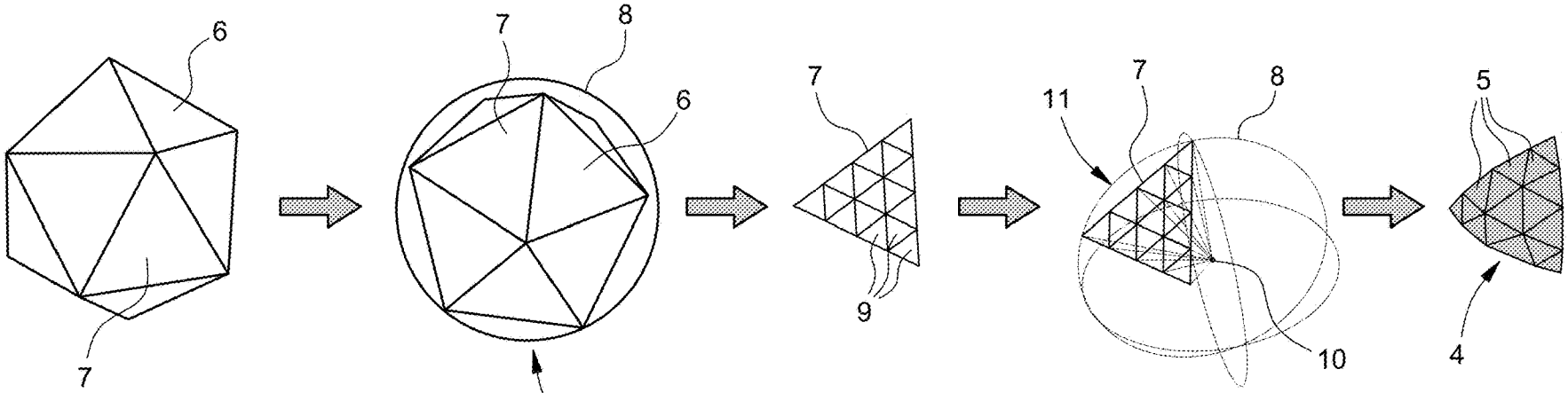
FIG. 2 shows the geometric operations with which the emission surface of the lighting apparatus of the invention is defined.

In particular, as schematically shown in FIG. 2, the shape of the individual sector 2 or module 3 is obtained as follows:

defining a starting regular polyhedron 6 having a plurality of equal polygonal plane faces 7;

obtaining the sphere 8 circumscribing the polyhedron (the sphere passing through all the vertices of the polyhedron 6, and in which the polyhedron 6 is inscribed);

dividing each face 7 of the polyhedron 6 into a plurality of equilateral polygons 9;

projecting the vertices of the polygons 9 from the centre 10 of the sphere 8 onto the surface 11 of the sphere 8, thus obtaining a plurality of projection points on the surface 11 of the sphere 8;

joining the projection points thus identified on the surface 11 of the sphere 8 with a plurality of polygonal plane faces, which constitute the faces 5 together defining the polyhedral surface 4 of the sector 2, i.e. of the module 3.

In the illustrated embodiment, the starting polyhedron 6 for the construction of the polyhedral surface 4 of each sector 2 or module 3 is an icosahedron; each sector 2 or module 3 is therefore geometrically defined by the second degree development of an icosahedron on a sphere:

a regular icosahedron 6 (a polyhedron with twenty plane faces 7 in the shape of an equilateral triangle) is defined;

the sphere 8 circumscribing the icosahedron 6 (the sphere passing through all the vertices of the icosahedron 6, and in which the icosahedron 6 is inscribed) is obtained;

each face 7 of the icosahedron 6 is divided into 16 equilateral triangles 9;

the vertices of these triangles 9 are projected from the centre of the sphere 8 onto the surface 11 of the sphere 8, thus obtaining a plurality of projection points on the surface 11;

the projection points thus identified are joined on the surface 11 of the sphere 8 with a plurality of triangular plane faces 5, thus obtaining the polyhedral surface 4 formed by 16 triangular plane faces 5.

It is understood that sectors 2 and modules 3 having different shapes can be realized.

Furthermore, the apparatus 1 may comprise a different number of sectors 2, i.e. of modules 3, organized differently from the non-limiting embodiment described and illustrated herein purely by way of example.

In the embodiment of FIG. 1, the apparatus 1 comprises 20 sectors 2, that is also 20 modules 3, arranged with a central symmetry around the axis A.

At least some of the modules 3 (optionally all the modules 3) are light modules having a lighting function as they are provided with respective light sources.

In the illustrated embodiment, for example, all sectors 2 except one define respective light modules 3, whereas a sector 2*a* defines a service module 3*a* that has no lighting function; the service module 3*a* is devoid of a light source and is intended for the passage of a power cable (not shown) which supplies power to the light modules 3, and possibly for supporting the apparatus 1, for example if it is connected to an optional support base (not shown for simplicity).

Figure 4:
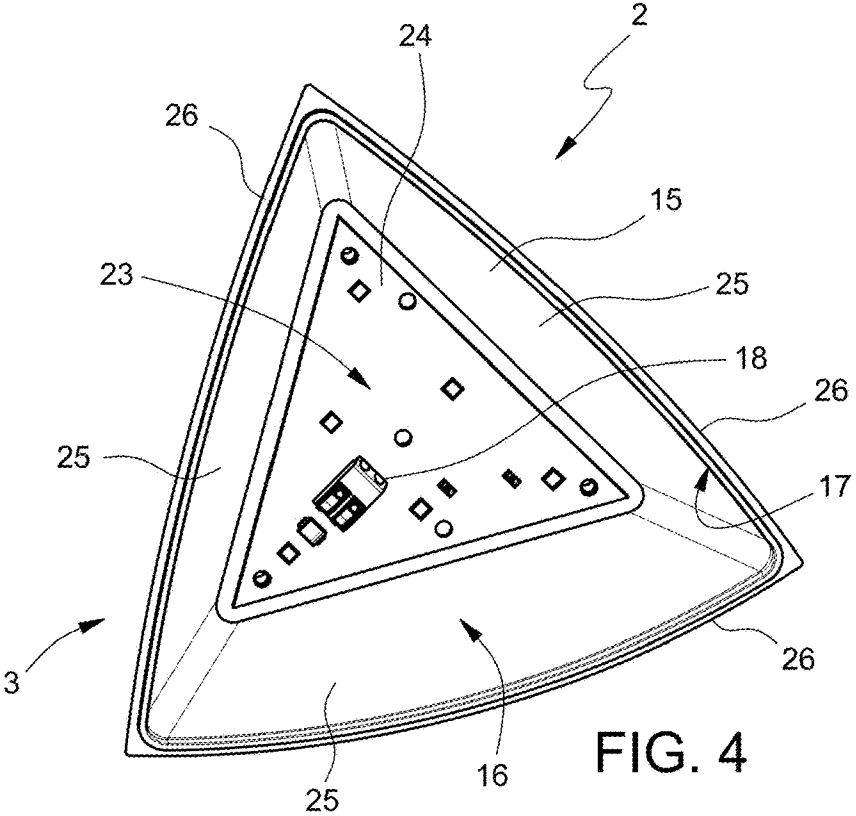
FIG. 4 is a perspective view of the light module in FIG. 3, with parts removed for clarity.
Figure 3:
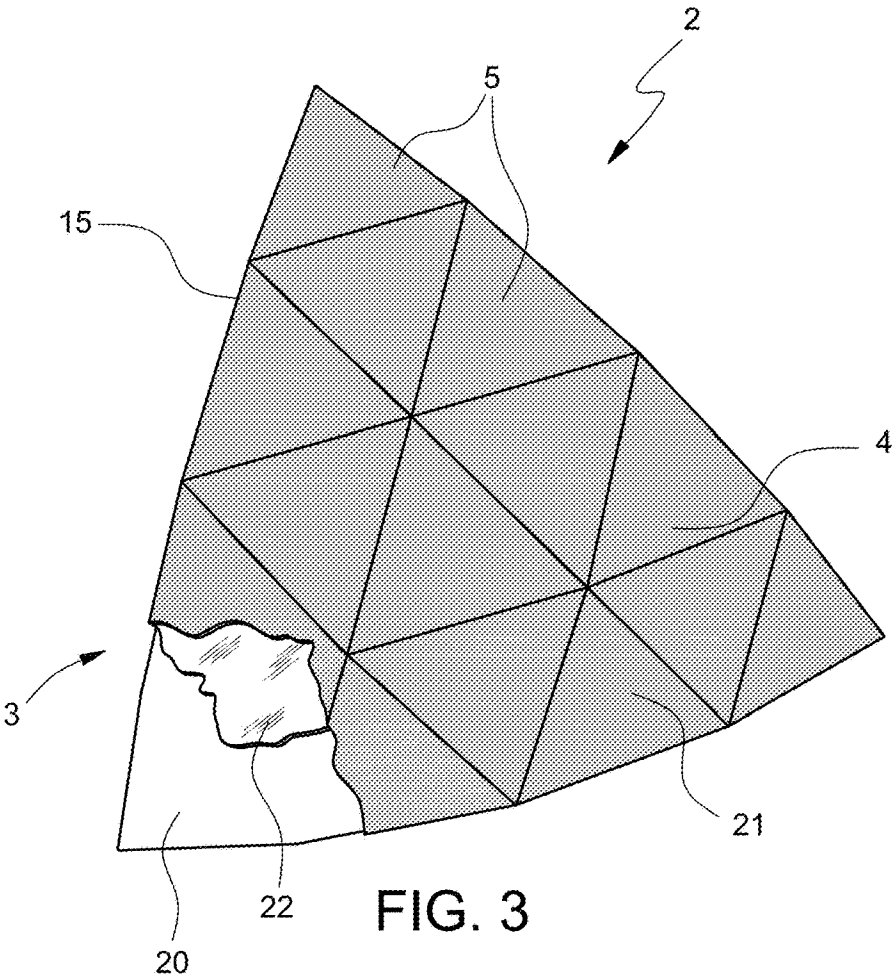
FIG. 3 is a perspective view, with a detail in cross section, of a light module forming part of the lighting apparatus in FIG. 1.

As shown in greater detail in FIGS. 3 and 4, each sector 2, i.e. each module 3, comprises: a hollow body 15 extending along and about an axis B and defining a light box 16 having a light exit opening 17; a LED light source 18 positioned at one end of the light box 16 opposite the opening 17 and facing the opening 17 and along the axis B so as to emit light towards the opening 17; a diffusing screen 20 positioned on the opening 17 to uniform the light passing through the opening 17; a closure cover 21 positioned above the diffusing screen 20 and provided with a transparent capacitive film 22 positioned on a face of the closure cover 21; a control unit 23, for example an electronic board, connected to the source 18.

The body 15 has a polyhedral cross section.

In the illustrated example, the body 15 (and therefore each module 3) has a triangular bottom wall 24 and a tern of lateral walls 25 extending from respective sides of the bottom wall 24 about the axis B, diverging from the axis B, and together defining the light box 16.

The lateral walls 25 end with respective polygonal end edges 26 (i.e. defined by respective broken lines formed by a range of segments) delimiting the light exit opening 17.

The light box 16 houses the source 18, preferably (but not necessarily) a white light source.

The light box 16 is covered with a very high-reflectivity (in particular, greater than or equal to 95%) diffusing white material.

The opening 17 is closed by the diffusing screen 20, which is made of a diffusing material capable of uniforming the light passing through the opening 17; and by the closure cover 21, which is positioned above the diffusing screen 20 and is made of a light-transparent material, for example in a colour different from white, preferably grey or black, so that it has a coloured (i.e. non-white) appearance, for example grey or black, when the source 18 is off, and that it defines a uniformly illuminated surface (particularly with white light) when the source 18 is on.

The closure cover 21 has a polyhedral outer surface, which constitutes the surface 4 of the module 3 and therefore is formed by the faces 5.

The diffusing screen 20 can be substantially flat or have the same shape as the closure cover 21, particularly as its polyhedral outer surface.

The capacitive film 22 preferably extends over the entire closure cover 21 and is connected to the control unit 23 to define a touch control device 27 of the module 3.

The capacitive film 22 can be positioned on an inner or outer face of the closure cover 21 and therefore be interposed between the diffusing screen 20 and the closure cover 21 (lying on the inner face of the closure cover 21), or be located above the closure cover 21 (on the outer face of the closure cover 21).

Preferably, the capacitive film 22 extends over the entire closure cover 21 (i.e. over the entire face of the closure cover 21 on which the capacitive film 22 is arranged), therefore over the entire sector 2. Accordingly, the touch control device 27 of the module 3 extends over the entire surface 4 of the module 3.

It is understood that the touch control device 27 can be configured differently from what is described herein purely by way of example.

In general, the term touch control device relates to a control device, which is sensitive to the touch or the presence (proximity) of a finger of a user and is then activated by the contact or proximity of the fingers of a user. The touch control device does not necessarily require direct contact with the user's fingers, but can also operate by proximity.

Therefore, in some embodiments, the touch control device 27 (again preferably extended over the entire surface of the respective sector 2, i.e. module 3), for example, includes a proximity sensor, in particular an optical proximity sensor or photoelectric sensor.

The control unit 23 is configured to control the operation of the source 18 of the module 3 by switching on/off the source 18 and preferably also adjusting the intensity of the light emitted by the source 18.

Each module 3 provided with the above-described components defines an independent light module, as the respective control unit 23 is configured to control the operation of the module 3 (by switching on/off and optionally adjusting the luminosity) independently of the operation of the other modules 3.

The apparatus 1 has an overall emission surface 30 (FIG. 1) which is defined by the assembly of all the surfaces 4 of the modules 3, i.e. of the respective emission surfaces.

The sectors 2, i.e. the modules 3, are adjacent to each other along respective lateral walls 25, thereby forming the apparatus 1. The sectors 2, i.e. the modules 3, can be joined together to form the apparatus 1 in various ways, for example being supported by a central core in the form of a central polyhedron located along the axis A in the centre of the apparatus 1 (not shown for simplicity).

In use, each module 3 can be switched on/off independently of the others.

The user switches on/off each individual module 3 by directly interacting with the respective surface 4 which also constitutes its light-emitting surface; and can also optionally vary the luminosity, again with a touch command on the same surface.

The overall emission surface 30 of the apparatus 1, defined by the assembly of all the surfaces 4 of the light modules 3, may appear completely black/grey (or generally coloured, not white) when all the modules 3 are off; fully illuminated, possibly except for the portion consisting of the service module 3*a* (devoid of a light source), when all the light modules 3 are on; partially black/grey (or coloured) and partially illuminated when some light modules 3 are on and others are off.

Therefore, the apparatus 1 has a black/grey (or coloured) appearance when it is off, whereas it is illuminated when it is on.

The apparatus 1 does not have a preferential orientation to perform lighting tasks; in any position, it is the activation of certain sectors 2 (i.e. modules 3) which makes the apparatus 1 a direct, indirect or mixed emission apparatus.

Lastly, it is understood that further modifications and variations can be made to the lighting apparatus as described and illustrated herein without departing from the scope of the accompanying claims.

The invention claimed is:

1. A lighting apparatus comprising:

a plurality of light modules arranged around a first axis (A), each light module comprising:

a hollow body extending along and about a second axis (B) and defining a light box having a light exit opening;

a closure cover;

a LED light source, housed in the light box;

a control unit connected to the source;

a diffusing screen positioned on the opening to uniform the light passing through the opening, wherein the closure cover is positioned above the diffusing screen; and a proximity sensor positioned on a face of the closure cover and connected to the control unit to define at least part of a touch control device of the light module; and at least one service module arranged around the first axis (A), the service module configured without a LED light source, wherein the plurality of light modules and the service module are shaped as respective polyhedral sectors arranged around the first axis (A) and each light module defines an independent light module controlled by the respective touch control device independently of the other light modules, wherein the closure cover of each light module and the service module has an outer surface defining an outer surface of the respective light module and the service module, the outer surface of the closure cover being a polyhedral surface formed by a plurality of polygonally outlined plane faces;

wherein the shape of each light module and the service module is geometrically defined by the second degree development of a regular polyhedron comprising a plurality of equal polygonal plane faces on a sphere circumscribing the polyhedron; and wherein each of the plurality of plane faces comprises at least 16 equilateral polygons.

2. The lighting apparatus according to claim 1, wherein each light module has a triangular bottom wall and a tern of lateral walls extending from respective sides of the bottom wall about the second axis (B), diverging from the second axis (B), and together defining the light box.

3. The lighting apparatus according to claim 2, wherein the lateral walls end with respective polygonal end edges delimiting the opening, which is provided with the diffusing screen and closed by the closure cover.

4. The lighting apparatus according to claim 1, wherein the light box is covered with a high-reflectivity diffusing white material.

5. The lighting apparatus according to claim 1, wherein the diffusing screen is made of a diffusing material capable of uniforming the light passing through the opening.

6. The lighting apparatus according to claim 1, wherein the shape of each light module and the service module is geometrically defined by the second degree development of an icosahedron polyhedron on the sphere circumscribing the polyhedron.

7. The lighting apparatus according to claim 1, wherein each light module is switched on/off independently of the others by the respective touch control device.

8. The lighting apparatus according to claim 1, wherein the closure cover is made of a grey or black transparent material, so that it has a coloured appearance when the source of the light module is off, and that it defines a uniformly illuminated surface when the source is on.

9. The lighting apparatus according to claim 8, wherein the apparatus has an overall emission surface, defined by the assembly of respective emission surfaces of the light modules, which appears grey or black when all the light modules are off; fully illuminated, except for a portion defined by the service module, when all the light modules are on; partially grey or black and partially illuminated when some light modules are on and others are off.

10. A lighting apparatus comprising:

a plurality of light modules arranged around a first axis (A), each light module comprising:

a hollow body extending along and about a second axis (B) and defining a light box having a light exit opening;

a closure cover;

a LED light source, housed in the light box;

a control unit connected to the source;

a diffusing screen positioned on the opening to uniform the light passing through the opening, wherein the closure cover is positioned above the diffusing screen; and a proximity sensor positioned on a face of the closure cover and connected to the control unit to define at least part of a touch control device of the light module; and at least one service module arranged around the first axis (A), the service module configured without a LED light source, wherein the plurality of light modules and the service module are shaped as respective polyhedral sectors arranged around the first axis (A) and each light module defines an independent light module controlled by the respective touch control device independently of the other light modules, wherein the closure cover of each light module and the service module has an outer surface defining an outer surface of the respective light module and the service module, the outer surface of the closure cover being a polyhedral surface formed by a plurality of polygonally outlined plane faces;

wherein the shape of each light module and the service module is geometrically defined by the second degree development of a polyhedron on a sphere circumscribing the polyhedron; and wherein the shape of each light module and the service module is further defined by the geometric operations of: defining a starting regular polyhedron having a plurality of equal polygonal plane faces; obtaining a sphere circumscribing the polyhedron; dividing each face of the polyhedron into at least 16 equilateral polygons; projecting the vertices of the polygons from the centre of the sphere onto the surface of the sphere, thus obtaining a plurality of projection points on the surface of the sphere; joining the projection points thus identified on the surface of the sphere with a plurality of polygonal plane faces, which constitute the faces together defining the polyhedral surface of the light module and the service module.

11. The lighting apparatus according to claim 10, wherein each light module has a triangular bottom wall and a tern of lateral walls extending from respective sides of the bottom wall about the second axis (B), diverging from the second axis (B), and together defining the light box.

12. The lighting apparatus according to claim 11, wherein the lateral walls end with respective polygonal end edges delimiting the opening, which is provided with the diffusing screen and closed by the closure cover.

13. The lighting apparatus according to claim 10, wherein the light box is covered with a high-reflectivity diffusing white material.

14. The lighting apparatus according to claim 10, wherein the diffusing screen is made of a diffusing material capable of uniforming the light passing through the opening.

* * * * *